US009801457B2

(12) United States Patent
Moreau et al.

(10) Patent No.: US 9,801,457 B2
(45) Date of Patent: Oct. 31, 2017

(54) TOOL COLLET FOR SECURING A HAND TOOL TO A TOOL LANYARD

(71) Applicant: Ty-Flot, Inc., Manchester, NH (US)

(72) Inventors: Darrell A. Moreau, Manchester, NH (US); Andre W. Moreau, Bedford, NH (US)

(73) Assignee: Ty-Flot, Inc., Manchester, NH (US)

( * ) Notice: Subject to any disclaimer, the term of this patent is extended or adjusted under 35 U.S.C. 154(b) by 0 days.

(21) Appl. No.: 15/067,345

(22) Filed: Mar. 11, 2016

(65) Prior Publication Data

US 2016/0192766 A1 Jul. 7, 2016

Related U.S. Application Data

(63) Continuation-in-part of application No. 14/536,010, filed on Nov. 7, 2014.

(51) Int. Cl.

| | |
|---|---|
| ***A45F 5/00*** | (2006.01) |
| ***B25B 3/00*** | (2006.01) |
| ***B25H 3/00*** | (2006.01) |

(52) U.S. Cl.

CPC ..... *A45F 5/00* (2013.01); *B25H 3/00* (2013.01); *A45F 2005/002* (2013.01); *A45F 2005/006* (2013.01); *A45F 2200/0575* (2013.01)

(58) Field of Classification Search

CPC . B25H 3/00; A45F 2005/002; A45F 2005/006
See application file for complete search history.

(56) References Cited

U.S. PATENT DOCUMENTS 2,633,375 A * 3/1953 Wilcoxon ..... B63B 21/56 254/389
5,286,130 A * 2/1994 Mueller ..... B66C 1/66 294/215

(Continued)

FOREIGN PATENT DOCUMENTS

JP 2001-322075 A 11/2001
JP 2008-284633 A 11/2008

OTHER PUBLICATIONS

Webpage of Python Safety (www.pythonsafety.com/product-groups/attachment-points/) printed Nov. 7, 2014.

(Continued)

*Primary Examiner* — Robert J Sandy
*Assistant Examiner* — Jason W San
(74) *Attorney, Agent, or Firm* — Robert R. Deleault, Esq.; Mesmer & Deleault, PLLC

(57) ABSTRACT

A method of creating a shear across a fastener for a tool collet being attached to a hand tool includes providing a tool collet having a collet body with a peripheral body surface and a collet through opening where the collet body is divided into a first body component and a second body component attachable to each other and where one of the first body component and the second body component has a first radial through aperture extending from the peripheral body surface to the collet through opening, providing a setscrew within the first radial through aperture, inserting a hand tool into the collet through opening, securing the first body component to the second body component, and tightening the setscrew against the hand tool sufficient to cause the first body component and the second body component to slide in opposite directions transversely to the portion of the hand tool.

10 Claims, 6 Drawing Sheets

(56) References Cited

U.S. PATENT DOCUMENTS 5,405,210 A * 4/1995 Tsui ..... B21K 1/72 403/119
5,634,734 A * 6/1997 Schron, Jr. ..... B66C 1/66 294/215
5,842,256 A * 12/1998 Anscher ..... A44B 99/00 24/170
5,975,786 A * 11/1999 Chang ..... B66C 1/66 116/212
6,017,071 A * 1/2000 Morghen ..... B66C 1/66 294/215
6,032,993 A * 3/2000 Kwon ..... B66C 1/66 294/215
6,068,310 A * 5/2000 Fuller ..... B66C 1/66 294/215
6,199,925 B1 * 3/2001 Alba ..... B66C 1/66 294/215
6,216,319 B1 * 4/2001 Elkins ..... A45F 5/00 224/221
6,601,747 B1 * 8/2003 Chi Kuo ..... B25C 5/025 227/134
6,669,394 B1 * 12/2003 Rieber ..... A63G 9/12 403/164
6,953,212 B2 * 10/2005 Alba ..... B66C 1/66 294/217
7,036,858 B2 * 5/2006 Buck ..... B66C 1/66 294/215
7,114,872 B2 * 10/2006 Alba ..... F16D 1/12 294/215
7,354,304 B2 * 4/2008 Livingston ..... A45F 5/00 439/501
7,654,027 B1 * 2/2010 Grover ..... F16B 21/165 24/573.11
8,201,867 B2 * 6/2012 Thomeczek ..... B66C 1/66 294/215
D675,084 S * 1/2013 Moreau ..... A45F 5/00 D8/356
8,424,638 B1 * 4/2013 Guthrie ..... A62B 35/0068 182/3
8,516,732 B2 * 8/2013 Burnsed, Jr. ..... F41C 23/02 24/573.11
8,562,053 B2 * 10/2013 Davidson ..... B66C 1/10 294/215
8,596,701 B2 * 12/2013 Alba ..... B66C 1/66 294/215
8,622,675 B2 * 1/2014 Chen ..... F16B 35/06 411/371.2
8,622,676 B2 * 1/2014 Chen ..... F16B 35/06 411/371.2
8,757,693 B2 * 6/2014 Fuller ..... B66C 1/66 294/215
8,979,397 B2 * 3/2015 Henry ..... G03B 17/561 396/423
9,067,766 B1 * 6/2015 Bateman ..... B66C 1/66
9,247,787 B2 * 2/2016 Dering ..... A45F 5/00
9,285,658 B2 * 3/2016 Xu ..... G03B 17/563
D766,058 S * 9/2016 Moreau ..... D8/71
D766,059 S * 9/2016 Moreau ..... D8/71
D773,270 S * 12/2016 Moreau ..... D8/71
2008/0292303 A1 * 11/2008 Kope ..... G03B 17/566 396/423
2009/0208274 A1 * 8/2009 Liang ..... F16G 15/08 403/164
2009/0276979 A1 11/2009 Kauffman et al.
2010/0229347 A1 9/2010 Kish
2012/0048901 A1 * 3/2012 Wong ..... A45F 5/00 224/257
2012/0266414 A1 10/2012 Moreau et al.
2015/0060476 A1 * 3/2015 Moreau ..... B25H 3/00 220/752
2015/0289633 A1 10/2015 Moreau et al.
2015/0345546 A1 * 12/2015 Moreau ..... F16C 11/06 403/165
2016/0192766 A1 * 7/2016 Moreau ..... A45F 5/00 29/525.11

OTHER PUBLICATIONS

PCT international search report for PCT/US2016/022257 dated Nov. 18, 2016.
PCT written opinion of the international searching authority for PCT/US2016/022257 dated Nov. 18, 2016.

* cited by examiner

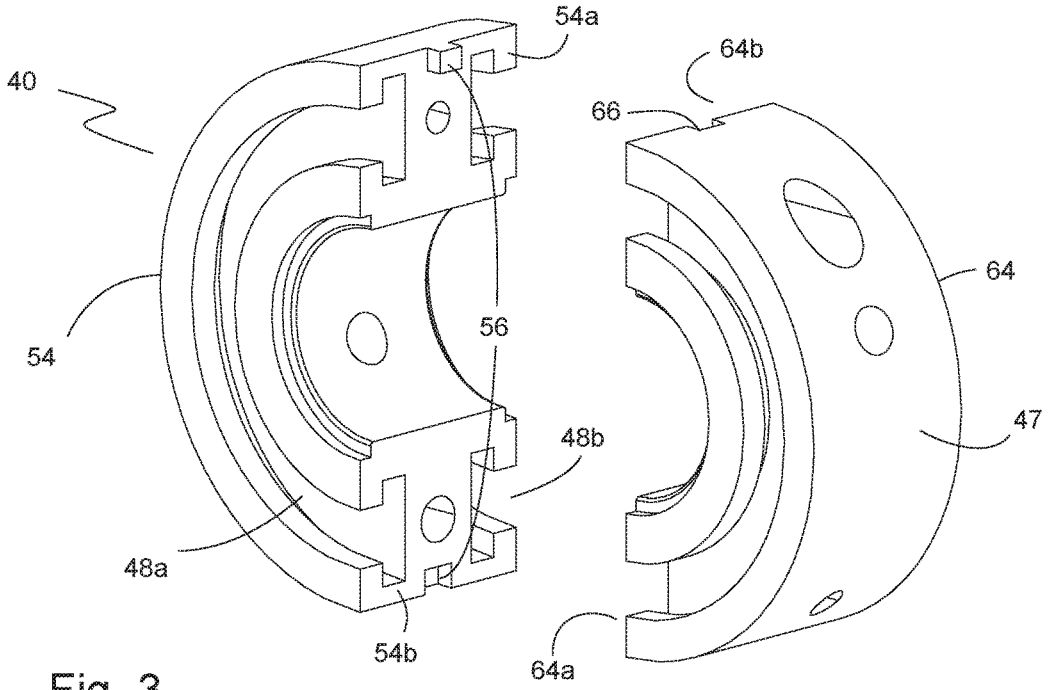
Fig. 3
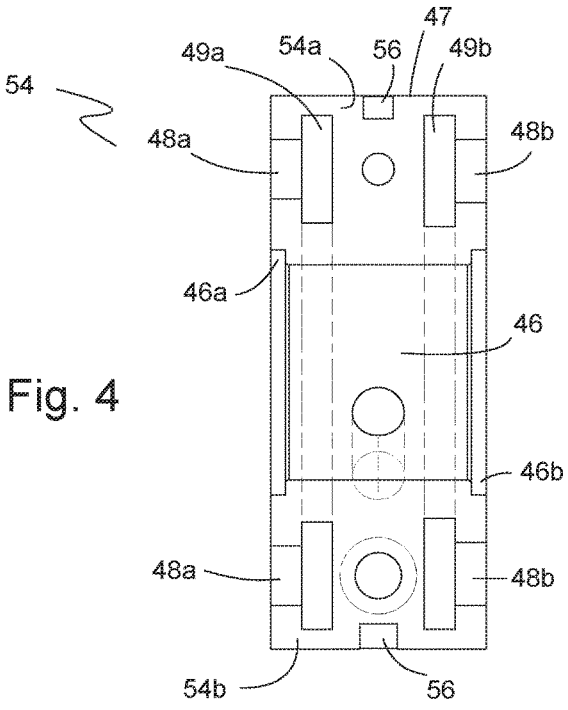
Fig. 4
Fig. 5
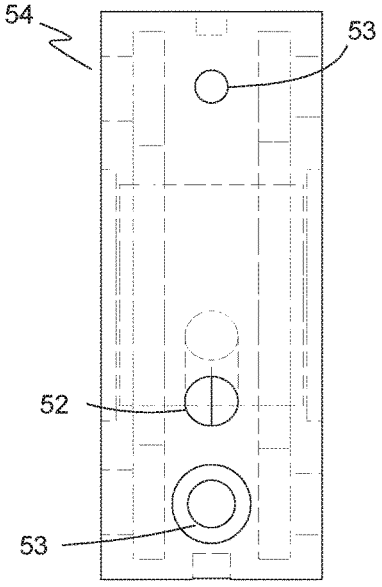

Fig. 6
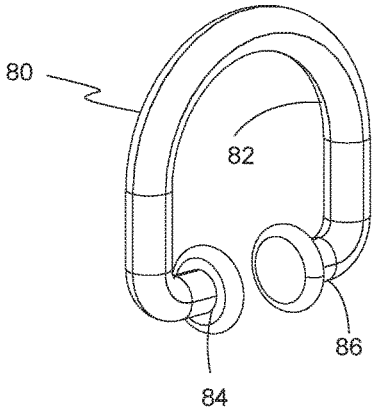
Fig. 7
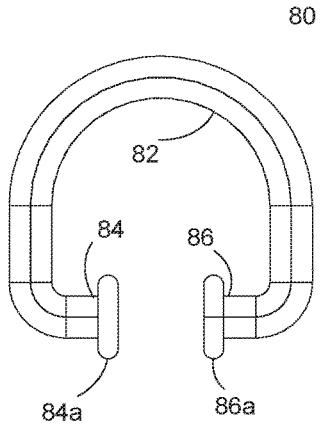
Fig. 9
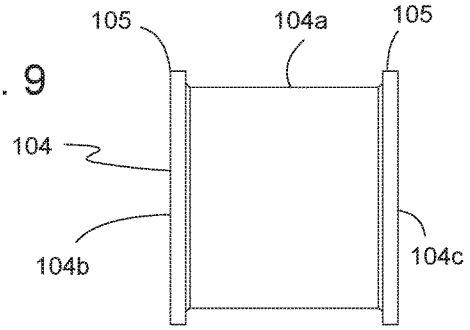
Fig. 8
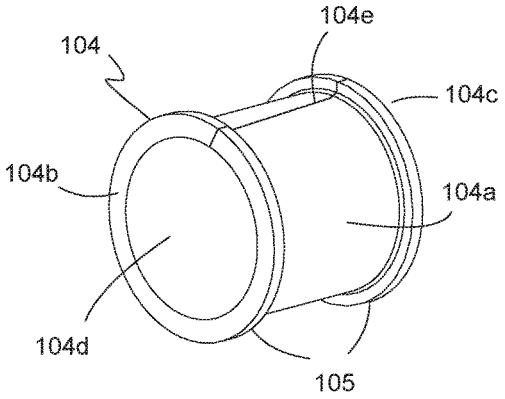
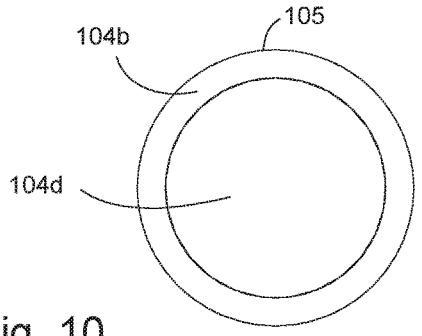
Fig. 10

Fig. 13
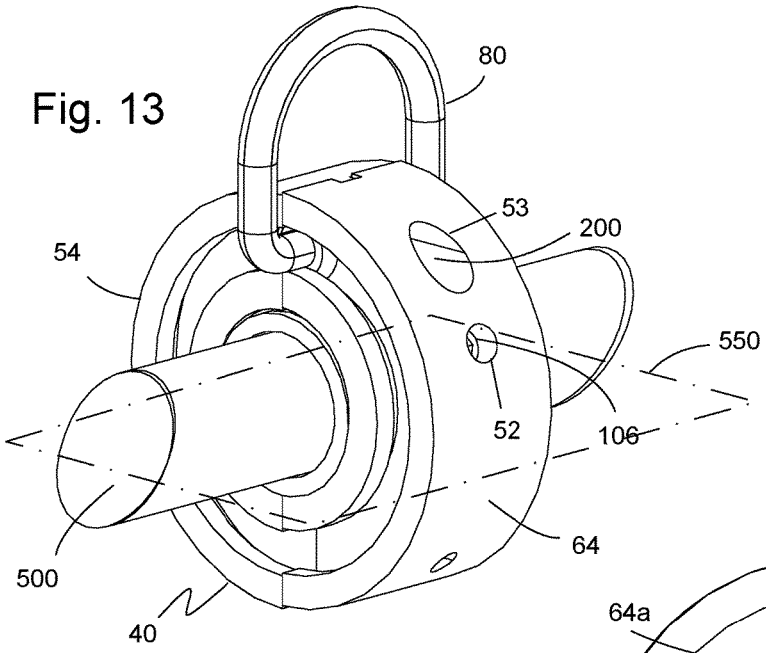
Fig. 14
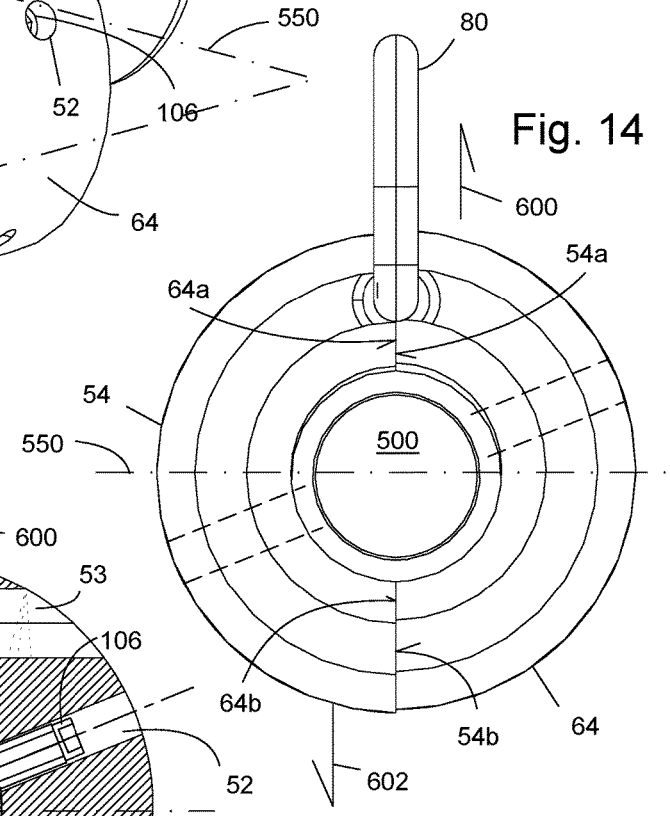
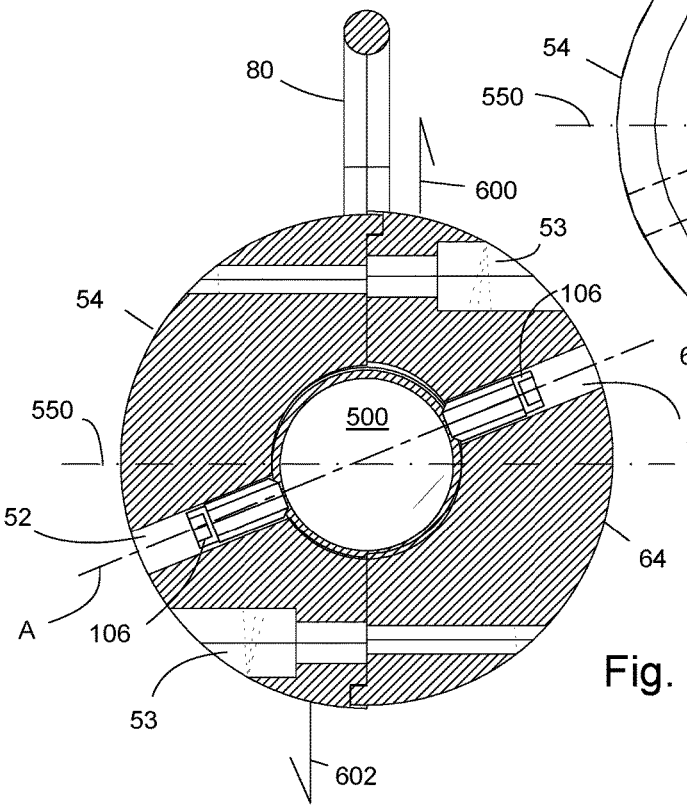
Fig. 15

TOOL COLLET FOR SECURING A HAND TOOL TO A TOOL LANYARD

BACKGROUND OF THE INVENTION

1. Field of the Invention

The present invention relates generally to hand tools and accessories. Particularly, the present invention relates to a drop-prevention apparatus for a hand tool.

2. Description of the Prior Art

Hand tools are widely used in construction, maintenance, and industrial facilities operations. The user of a tool often stores tools in a bag, box, pouch, or tool belt when the tool is not being used. The user then selects the appropriate tool for a given task and returns the tool to its storage location after the task is complete. For tasks performed at elevated heights, dropping a tool can cause injury to individuals or damage to objects below the worker. The dropped tool also is a significant inconvenience for workers who must spend time to retrieve the dropped tool.

Lanyards, tethers, hooks, and similar restraints are used to prevent accidental dropping of tools. These restraints are particularly useful for workers at height and in environments where a tool drop can cause substantial damage or harm to plant equipment, to workers, or to objects below a worker who accidentally drops a tool.

One method of tethering a tool includes clipping one end of a tether to an opening in the handle of a tool (e.g., an adjustable wrench) and to clip the other end of the tether to the worker's belt or to a nearby structure. When workers properly tether a tool in this way, accidental drops can be eliminated or greatly reduced.

One method of addressing the problem of dropped tools has been to mold a sleeve snugly over and taking the shape of the tool's handle or grip. The sleeve has a solid end with an opening in the solid end through which a tether may be attached. For example, one line of tools includes hammers, hinged pliers, and adjustable spanners that have a rubber sleeve molded over the handle of the tool with a solid end portion of the sleeve extending beyond the end of the handle. A ring passes through an opening or grommet in the solid end portion of the rubber sleeve. The user clips one end of a lanyard to the ring and attaches the other end of the lanyard to the user's tool belt, scaffolding, ladder, or other object.

Another approach to preventing dropped tools is disclosed in U.S. Pat. No. 6,216,319 to Elkins for a hardware receptacle. The receptacle is a cylindrically-shaped rubber cap with an open end and a closed end. The receptacle is adapted to fit over the end of tools and pieces of hardware of different sizes and generally has a thin wall so as to be pliable and moldable to the various tools and components. Holes extend through the closed end of the receptacles to provide vents that help alleviate suction that may occur when removing a tool or piece of hardware from the receptacles, thus making it easier to remove the hardware.

A further approach to preventing dropped tools is disclosed in US published application no. 2010/0229347-A1 to Kish. The Kish published application discloses a holder adapted to be attached to a tool to prevent a dropped tool from being lost or forgotten during use. The holder has a hollow member with an open end and a closed end. The closed end has a centrally-located opening through which a swivel connector is attached. The hollow member is made of rubber or plastic and the wall of the hollow member frictionally engages or grips a tool located in the hollow member.

Other tool tethering devices include a D-ring attached to a strip of webbing where the webbing is then taped to a tool such as a wrench by wrapping the tape around the webbing to create an attachment point for a lanyard. The D-ring and webbing may also include a cord attachment that cinches to a tool. Instead of using tape on the D-ring, shrink tubing has also been used to surround the webbing and a portion of the tool to create an attachment point for a lanyard.

SUMMARY OF THE INVENTION

There exist various devices for creating a lanyard attachment point on a hand tool. The purpose of these devices is to create a point of attachment on a hand tool to which a tool safety lanyard can be attached. The tool safety lanyard is important for those workers working at a height since at some point each worker will experience inadvertently dropping a tool. The dropped tool is dangerous as it may cause damage to expensive equipment or injury to others below.

The existing devices typically use tape or heat shrink tubing to secure a D-ring webbing to a hand tool to create an attachment point for the safety lanyard. Because tape and/or heat shrink tubing is used to secure the D-ring webbing to the hand tool, the D-ring webbing is positioned on the hand tool in a location where a portion of the hand tool adjacent to the attachment point on the hand tool is wider than the attachment point. This is done so that the D-ring webbing cannot be pulled past the wider portion of the hand tool. This is especially important when a hand tool attached to a tool safety lanyard is inadvertently or accidentally dropped. The forces exerted on the D-ring webbing when the tool safety lanyard arrests the dropping tool are sufficiently strong that the tape and/or shrink tubing could be caused to slide off of the hand tool but for the wider portion of the hand tool preventing this from happening.

These devices suffer from a serious disadvantage when they are used on a metal shaft of punch pins, on alignment pins and/or on drift pins such as those used in steel construction for aligning bolt holes. Because the weight of these alignment pins and/or drift pins are several pounds, dropping one of these tools imparts relatively large forces on the D-ring webbing attached with tape or shrink tubing to the tool when the dropped tool is suddenly stopped from falling by the tool safety lanyard. Where alignment pins and/or drift pins are typically elongated rods with a taper over an end portion of the rod or with a taper over the entire rod from one end to the other, the D-ring webbing has no "shoulder" on the hand tool that would prevent the D-ring webbing secured with tape or heat shrink tubing from potentially being pulled over the end of the alignment pin and/or drift pin and releasing the hand tool to continue its fall.

It is an object of the present invention to provide a tool collet for creating a lanyard attachment point on a hand tool.

It is another object of the present invention to provide a tool collet for creating a lanyard attachment point on a hand tool that has an elongated body with either a tapered longitudinal cross-section or a constant longitudinal cross-section to one end of the hand tool.

The present invention achieves these and other objectives by providing a tool collet for creating a lanyard attachment point on a hand tool that includes a collet body, a lanyard ring connected to the collet body and one or more fastening members. In one embodiment, the collet body has a first body side, a second body side, a peripheral body surface between the first body side and the second body side, a collet through opening with an opening surface, and an annular groove in one of the first body side, the second body side or the peripheral body surface of the collet body. The collet body is typically divided into a first body component and a second body component that is fixedly attached to the first body component where the through opening is formed by the first body component and the second body component. The lanyard ring has an annular end disposed and captured within the annular groove where the lanyard ring freely slides along the annular groove. The one or more fastening members extend between the first body component and the second body component where the fastening members are adapted to securely fix the first body component to the second body component and the tool collet to the hand tool.

In another embodiment of the present invention, the tool collet includes a gripping member disposed within the collet through opening adjacent the surface of the collet through opening.

In a further embodiment of the present invention, the gripping member is one of (1) the surface of the collet through opening having a gripping finish, (2) an insert having an insert through opening where the insert is disposed within the through opening of the collet body, (3) one or more inserts disposed within one or more corresponding recesses in the opening surface of the through opening, and (4) one or more setscrews that penetrate radially through the tool collet to the through opening to engage the hand tool.

In still another embodiment, the insert is flexibly resilient.

In yet another embodiment, the collet body is annularly shaped.

In one embodiment of the present invention, the annular groove is a single annular groom located within the peripheral body surface of the collet body.

In another embodiment of the present invention, the annular groove includes a first annular groove in the first body side of the collet body and a second annular groove in the second body side of the collet body opposite the first annular groove where the first annular groove and the second annular groove are adjacent the peripheral body surface of the collet body.

In another embodiment of the present invention, the annular groove has a cross-section that is T-shaped and the captured annular end of the lanyard ring within the annular groove has a cross-section that is T-shaped.

In another embodiment of the present invention, the collet through opening has a cross-section selected from the group consisting of a circular cross-section and a polygonal cross-section.

In a further embodiment of the present invention, the gripping finish of the opening surface is a knurled finish.

In still another embodiment of the present invention, the insert with a through opening has an outer insert surface with a cross-section that is circular when the collet through opening is circular or an outer insert surface with a matching polygonal cross-section when the collet through opening is a polygon.

In yet another embodiment, the insert disposed within a recess in the opening surface is an elongated, resilient, gripping member disposed within the recess and extending a predefined distance away from the opening surface and into the through opening.

In another embodiment of the present invention, there is a combination hand tool and a tool collet for creating a lanyard attachment point on the hand tool. The combination includes a hand tool having an elongated body that extends to a first hand tool end where the elongated body has a predefined cross-sectional diameter that is equal to or larger than a cross-sectional diameter of the first hand tool end. The combination also includes a tool collet attached to the elongated body of the hand tool, a lanyard ring, and one or more fastening members. The tool collet has a collet body having a first body side, a second body side, a peripheral body surface between the first body side and the second body side, a collet through opening with an opening surface, and an annular groove in one of the first body side, the second body side or the peripheral body surface of the collet body. The collet body may be divided into a first body component and a second body component fixedly attached to the first body component and where the through opening is formed by the first body component and the second body component. The through opening surrounds and securely attaches to the elongated body of the hand tool. The lanyard ring has an annular end adapted to be disposed and captured within the annular groove where the lanyard ring is adapted to freely slide along the annular groove. The one or more fastening members extend between the first body component and the second body component where the one or more fastening members are adapted to securely fix the first body component to the second body component.

In another embodiment, there is disclosed a tool collet kit for creating a lanyard attachment point on a hand tool that includes a collet body with a through opening, an annular groove in one of a first body side of the collet body, a second body side of the collet body or a peripheral body surface of the collet body, a lanyard ring having an annular end adapted to be disposed and captured within the annular groove where the lanyard ring is adapted to freely slide along the annular groove, and one or more fastening members adapted to securely fix the collet body around an elongated body of a hand tool.

BRIEF DESCRIPTION OF THE DRAWINGS

FIG. 3 is an enlarged, perspective view of one embodiment of the collet body of the tool collet shown in FIG. 1.

FIG. 4 is a cross-sectional view of the collet body shown in FIG. 3.

FIG. 5 is a plan view of the collet body shown in FIG. 3.

FIG. 6 is a perspective view of one embodiment of a lanyard ring of the tool collet shown in FIG. 1.

FIG. 7 is a plan view of the lanyard ring shown in FIG. 6.

FIG. 8 is an enlarged, perspective view of one embodiment of a gripping insert of the tool collet shown in FIG. 1.

FIG. 9 is a cross-sectional view of the gripping insert shown in FIG. 8.

FIG. 10 is an end view of the gripping insert shown in FIG. 8.

FIG. 13 is a perspective view of one embodiment of the present invention showing a tool collet on a hand tool with the set screws causing an offset torque against the collet fastener(s).

FIG. 14 is a side view of the embodiment in FIG. 13 showing the offset of the two collet halves when the set screws are tightened against the hand tool.

FIG. 15 is a cross-sectional view of the embodiment in FIG. 13 showing the offset in the collet fastener hole.

DETAILED DESCRIPTION OF THE INVENTION

Figure 1:
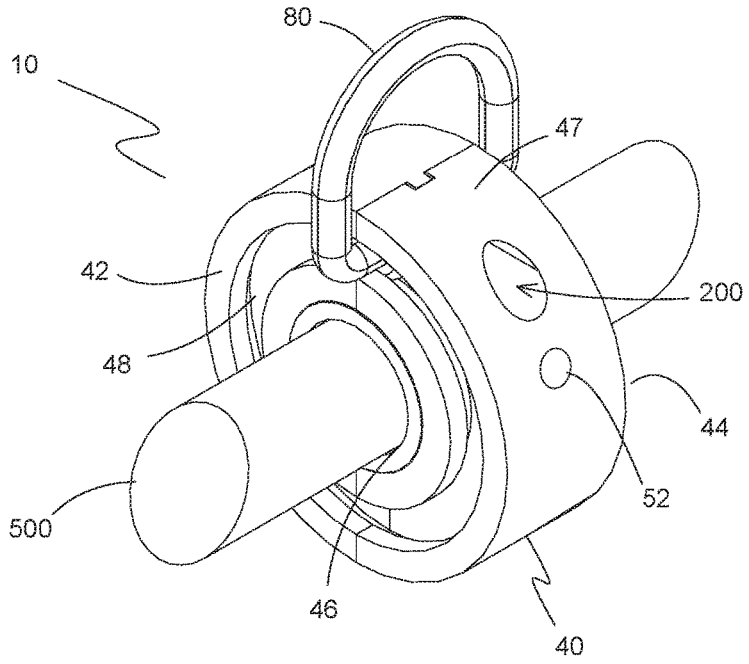
FIG. 1 is a perspective view of one embodiment of the present invention showing a tool collet for creating a lanyard attachment point on a hand tool attached to a portion of a hand tool.
Figure 2:
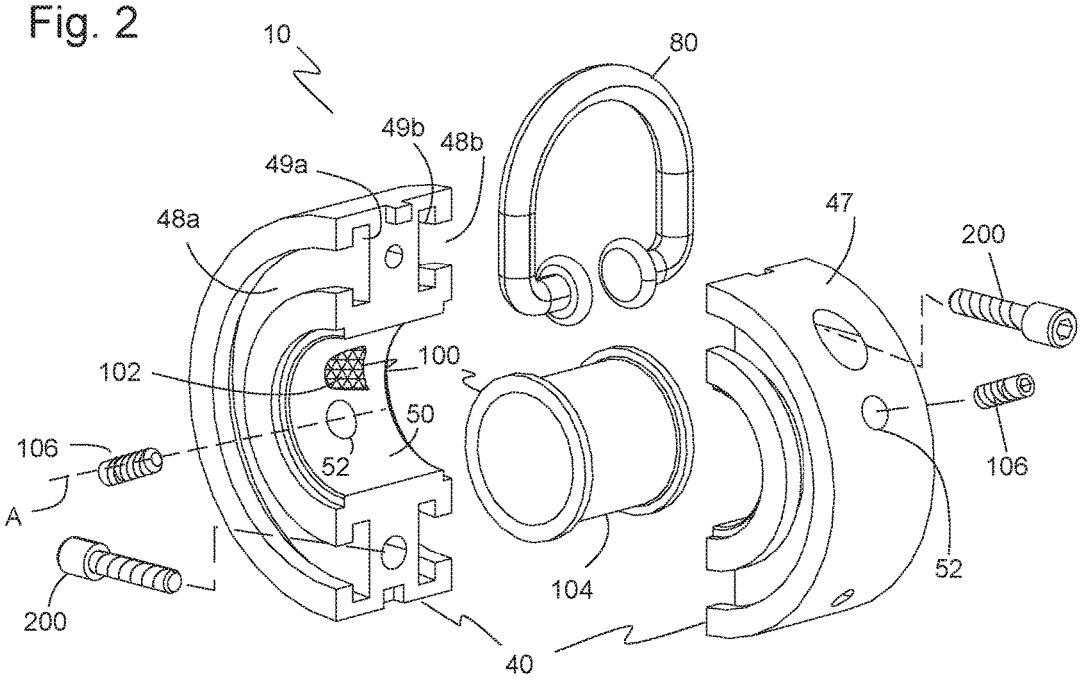
FIG. 2 is an expanded view of the tool collet shown in FIG. 1.

The preferred embodiments of the present invention are illustrated in FIGS. 1-16. FIGS. 1 and 2 show one embodiment of a tool collet 10 for creating a lanyard attachment point on a hand tool. Tool collet 10 includes a collet body 40, a lanyard ring 80 operatively engaged with collet body 40, and one or more fastening members 200 of collet body 40. In FIG. 2, tool collet 10 is shown mounted on a portion of the hand tool 500. Although tool collet 10 was designed to address the problem of securing a lanyard attachment point on drift pins and/or alignment pins, tool collet 10 may be used on many other hand tools having a cylindrically-shaped portion around which tool collet 10 may attach. Drift pins and/or alignment pins present a special problem with securing a lanyard attachment point. Because drift pins and/or alignment tools typically have a tapered design, it is difficult to provide a lanyard attachment point that will not slip off of the drift pin and/or alignment tool when the attached lanyard arrests or stops the fall of the hand tool. The forces exerted on the attachment point using any other lanyard attachment point design typically causes the release of the attachment point from the hand tool. The failure of the attachment point of a dropped tool can cause substantial damage or harm to plant equipment, to workers or to objects below a worker.

Tool body 40 has a first body side 42, a second body side 44, a collet through opening 46, and a peripheral body surface 47. Each of first and second body side 42, 44 has an annular groove 48 that retains lanyard ring 80 in a captured but slidable orientation. In this embodiment, annular groove 48 includes a first annular groove 48*a* with an annular recess 49*a* and a second annular groove 48*b* with an annular recess 49*b* where second annular groove 48*b* is opposite first annular groove 48*a*. Within collet through opening 46, there is disposed an optional gripping member 100 that engages hand tool 500 and prevents the movement of tool collet 10 on hand tool 500.

Optional gripping member 100 may be a gripping structure 102 integrally made in a collet opening surface 50 of collet through opening 46 (i.e. the inside surface of through opening 46). One example of a gripping structure 102 includes but is not limited to a knurled finish on collet opening surface 50. Optional gripping member 100 may also be an insert 104 that is disposed within through opening 46. Insert 104 is typically made of a flexibly resilient material such as, for example, rubber or other similar material that is capable of creating frictional contact between tool collet 10 and hand tool 500. Another embodiment of gripping member 100 includes an optional setscrew 106 that mates with a collet first radial through aperture 52 along the axis A. Setscrew 106 may include one or more setscrews that penetrate radially through tool collet 10 to the surface of hand tool 500 where each setscrew 106 mates with a corresponding radial through aperture 52. In FIG. 2, a second radial through aperture 52 is shown. When setscrew 106 is tightened, it fixes tool collet 10 to hand tool 500. It is contemplated that setscrew 106 may also be used with or without insert 104.

Turning now to FIG. 3, there is illustrated an enlarged and separated view of tool body 40. In this embodiment, tool body 40 has a first body component 54 and a second body component 64 where each of first and second body component 54, 64 is one-half of collet body 40. It is understood that first and second body component 54, 64 may have other size ratios relative to each other such as one-third to two-thirds. It is contemplated that assembly to hand tool 500 of collet body 40 having ratios other than 50-50 will require an appropriate adjustment in the assembly procedure. In this embodiment, each of first and second body component 54, 64 has a body component mating surface 54*a*, 64*a* and 54*b*, 64*b*. Optionally mating surfaces 54*a*, 64*a* and 54*b*, 64*b* have alignment members 56, 66 that insure first body component 54 and second body component 65 are properly aligned when assembled. Alignment members include a mating protrusion 56*a*, 66*a* and a corresponding mating recess 56*b*, 66*b*. Mating protrusion 56*a* is received in mating recess 66*b* and, if included, mating protrusion 66*a* is received in mating recess 56*b*.

FIG. 4 is a cross-sectional view of tool body 40. As is more clearly shown in this figure, each of first and second annular grooves 48*a*, 48*b* has a cross-section that is T-shaped. Each of annular groove 48*a*, 48*b* is adjacent peripheral body surface 47. In this embodiment, each annular groove 48*a*, 48*b* forms a full circle or ring within first body side 42 and second body side 44, respectively. By forming a full circle, annular groove 48 allows lanyard ring 80 to slide completely around the circumference of collet body 40. Through opening 46 may also include an optional annular recess 46*a* in first body side 42 and an optional annular recess 46*b* in second body side 44. Optional annular recess 46*a*, 46*b* may be provided to receive and retain insert 104, which will be further explained below.

FIG. 5 illustrates the front plan view of collet body 40 showing the internal surfaces in dashed lines. In this embodiment, peripheral body surface 47 includes one or more fastener openings 53 within collet body 40 that passes through from first body component 54 to second body component 64 where the one or more fastener openings 53 are adapted to receive a fastener 200 to secure first body component 54 to second body component 64 and vice-versa. Typically at least one of the fastener openings in first body component 54 and second body component 64 is threaded to match the threads on fastener 200. Although the present embodiment illustrates two fasteners 200, it is contemplated that one pair of mating surface 54*a*, 64*b* or 54*b*, 64*a* may be hingedly connected to each other while the other of the pair of mating surface 54*a*, 64*b* or 54*b*, 64*a* has fastener opening 53 and fastener 200. FIG. 5 also illustrates at least one, optional, radial through aperture 52 for receiving setscrew 106.

FIGS. 6 and 7 illustrate one embodiment of lanyard ring 80. In this embodiment, lanyard ring 80 has a D-ring shape with a ring body 82 and a pair of opposed ring ends 84, 86. Each of opposed ring ends 84, 86 has a circular ear 84*a*, 86*a*, respectively, that has a larger cross-sectional diameter than opposed ring ends 84, 86. Circular ears 84*a*, 86*a* have a cross-sectional diameter and a thickness less that the recessed groove 49*a*, 49*b* of annular groove 48*a*, 48*b* to allow lanyard ring 80 to be captured within annular groove 48 and to freely slide around the circumference of collet body 40. Lanyard ring 80 provides an attachment point for a tool lanyard.

FIGS. 8, 9 and 10 illustrate one embodiment of a gripping member 100 that is an insert 104. FIG. 8 is a perspective view of insert 104 having an cylindrical body wall 104*a*, a first body end 104*b*, and a second body end 104*c* forming an insert through opening 104*d*. Insert 104 may optionally have a slit 104*e* through cylindrical body wall 104*a* to facilitate attachment to a hand tool 500 by allowing the insert 104 to be opened along slit 104*e* and placed around the pre-selected location on hand tool 500. Cylindrical body wall 104*a* has an outer diameter that is substantially the same as inner diameter of collet through opening 46. First and second body ends 104*b*, 104*c* may optionally include end flanges 105 that nest within corresponding optional annular recesses 46*a*, 46*b* of collet body 40. FIG. 9 is a front plan view of insert 104 while FIG. 10 is an end view of insert 104.

Figure 11:
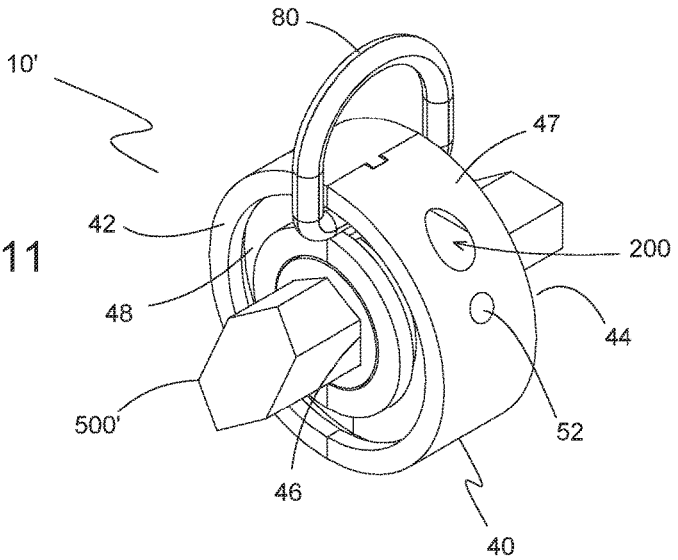
FIG. 11 is a perspective view of another embodiment of the tool collet for creating a lanyard attachment point on a hand tool attached to a hand tool with a polygonal cross-sectional shape.
Figure 12:
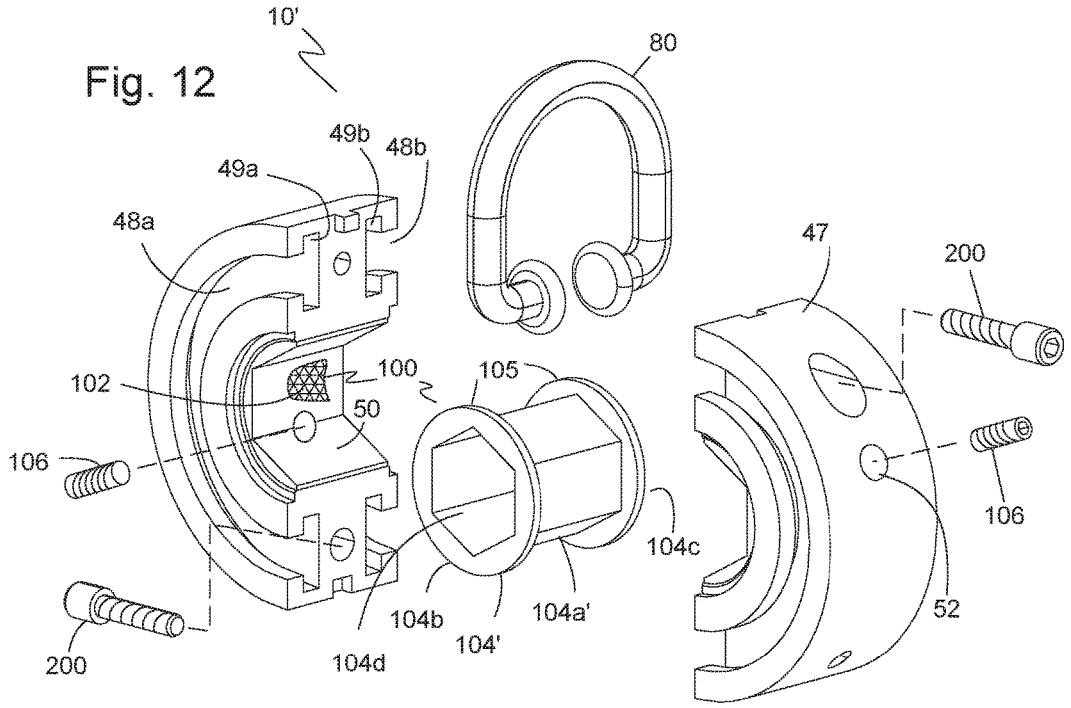
FIG. 12 is an expanded view of the tool collet shown in FIG. 11.

Turning now to FIGS. 11 and 12, there is illustrated another embodiment of tool collet 10' adapted for attachment to a hand tool with a hexagonal cross-sectional shape. Like tool collet 10, tool collet 10' has a collet body 40, a lanyard ring 80 operatively engaged with collet body 40, and one or more fastening members 200 of collet body 40. In this Figure, tool collet 10 is shown mounted on a portion of a hand tool 500'.

Tool body 40 has a first body side 42, a second body side 44, a collet through opening 46, and a peripheral body surface 47. Each of first and second body side 42, 44 has an annular groove 48 that retains lanyard ring 80 in a captured but slidable orientation. In this embodiment, annular groove 48 includes a first annular groove 48*a* with an annular recess 49*a* and a second annular groove 48*b* with an annular recess 49*b* where second annular groove 48*b* is opposite first annular groove 48*a*. Within collet through opening 46, there is disposed an optional gripping member 100 that engages hand tool 500' and prevents the movement of tool collet 10' on hand tool 500'.

Optional gripping member 100 may be a gripping structure 102 integrally made in an collet opening surface 50 of collet through opening 46 (i.e. the inside surface of through opening 46). One example of a gripping structure 102 includes but is not limited to a knurled finish on collet opening surface 50. Optional gripping member 100 may also be an insert 104' that is disposed within through opening 46. Insert 104' is typically made of a flexibly resilient material such as, for example, rubber or other similar material that is capable of creating frictional contact between tool collet 10 and hand tool 500'. Like the embodiment illustrated in FIGS. 1-2, this embodiment may also include another embodiment of gripping member 100 includes an optional setscrew 106 that mates with a collet first radial through aperture 52. Setscrew 106 may include one or more setscrews that penetrate radially through tool collet 10' to the surface of hand tool 500'. When setscrew 106 is tightened, it fixes tool collet 10' to hand tool 500'. It is contemplated that setscrew 106 may also be used with or without insert 104'.

The key difference in the embodiment shown in FIGS. 11-12 compared to the embodiment shown in FIGS. 1-2 is the collet opening surface 50 has a cross-sectional shape that matches the cross-sectional shape of hand tool 500'. In the illustrated case, it is a hexagonal cross-sectional shape but any polygonal shape may be used. Insert 104' also has an cylindrical body wall 104*a'* with a hexagonal cross-sectional shape to mate with the cross-sectional shape of hand tool 500', a first body end 104*b*, and a second body end 104*c* forming an insert through opening 104*d*. Insert 104' may optionally have a slit 104*e* (not shown in this figure but shown in FIG. 8) through cylindrical body wall 104*a'* to facilitate attachment to a hand tool 500'. Cylindrical body wall 104*a'* has an outer diameter and cross-sectional shape that is substantially the same as inner diameter and cross-sectional shape of collet through opening 46. First and second body ends 104*b*, 104*c* may optionally include end flanges 105 that nest within corresponding optional annular recesses 46*a*, 46*b* of collet body 40.

FIGS. 13-15 show the effect of incorporating the collet radial screw opening(s) 52 offset from a plane that bisects the angle defined by body component matting surfaces 54*a*, 54*b* and 64*a*, 64*b*. FIG. 13 illustrates tool collet 10 as including collet body 40 having first body component 54 and second body component 64, lanyard ring 80 operatively engaged with collet body 40, and one or more fastening members 200 (not shown) of collet body 40 disposed in one or more fastener openings 53. As shown, lanyard ring 80 is captured within annular groove 48 and slidable along annular groove 48. Tool collet 10 is shown mounted on a portion of hand tool 500. In this embodiment, optional insert 104 is disposed in collet through opening 46. Also shown in second body component 64 is first radial through aperture 52 for receiving setscrew 106. Plane 550 is shown in each of FIGS. 13-15 where plane 550 bisects the angle formed by body component matting surfaces 54*a*, 54*b* and 64*a*, 64*b*. In this case, the angle formed by matting surfaces 54*a*, 54*b* and 64*a*, 64*b* is 180 degrees.

FIG. 14 illustrates a side view of tool collar 10 shown in FIG. 13. In this particularly embodiment, two setscrews 106 are disposed in opposed first and second radial through openings 52. Radial through openings 52 are offset from plane 550. The unexpected advantage of offsetting radial through openings 52 from plane 550 will now be explained. When optional setscrew 106 is used in first radial through aperture 52, the effect of tightening setscrew 106 causes each of first and second body components 54, 64 to slide along mating surfaces 54*a*, 54*b*, 64*a*, and 64*b* in opposite directions. This is indicated by arrow 600 for second body component 64 and arrow 602 for first body component 54. This sliding effect creates a locking torque on fasteners 200 in fastener openings 53, which is more clearly shown in FIG. 15.

Turning now to FIG. 15, there is illustrated a cross-sectional view of tool collet 10. It is important to note that the axis A of the radial through aperture 52 is offset from plane 550. When setscrew 106 in radial through aperture 52 in first tool component 54 is tightened against the surface of hand tool 500, that action forces that portion of first tool component 54 near setscrew 106 to move slightly away from the surface of hand tool 500 which, in turn, causes the portion of first tool component 54 furthest away from setscrew 106 to move slightly closer to the surface of hand tool 500. In other words, the tightening of setscrew 106 causes first tool component 54 to move in the direction of arrow 602. Likewise, when a second setscrew 106 in radial through aperture 52 in second tool component 64 is tightened against the surface of hand tool 500, that action forces that portion of second tool component 64 near setscrew 106 to move slightly away from the surface of hand tool 500 which, in turn, causes the portion of second tool component 54 furthest away from setscrew 106 to move slightly closer to the surface of hand tool 500. In other words, the tightening of setscrew 106 causes second tool component 64 to move in the direction of arrow 600. This action applies a torquing action or shear between the threads of fastener 200 against the internal threads of fastener opening 53. This torquing action or shear effectively locks fastener 200 within fastener opening 53 without the need for thread locking adhesives/coatings or other structural locking mechanisms such as, for example, a locking thermoplastic thread insert.

Test Data on Effect of Setscrew Offset Use

Typically, when optional setscrew 106 is not used, fastening member/fastener 200 is tightened to a range of about 4-5 ft-lbs of torque. Because there is no shear created between fastening member/fastener 200 and fastener opening 53 in which fastener 200 is threaded in order to join first tool component 54 to second tool component 64 of tool collet 10, there is an unmeasurable torque (i.e. about 0 ft-lbs) needed to loosen fastening member/fastener 200 right after a torque sufficient to break the 4-5 ft-lbs of torque used to tighten fastener 200. Although it is quite difficult to measure the turn angle that fastener 200 must accomplish in order to gain the position of an unmeasurable torque when loosening fastener 200 that has been tightened to the range of about 4-5 ft-lbs, the loosening turn angle is estimated to be about 3 degrees from the tightened position.

On the other hand, when optional setscrew 106 is used and when radial through aperture 52 that receives setscrew 106 is offset from plane 550 which bisects the angle formed by body component matting surfaces 54*a*, 54*b* and 64*a*, 64*b*, there is a measurable torque or shear created between fastening member/fastener 200 and fastener opening 53 in which fastener 200 is threaded in order to join first tool component 54 to second tool component 64 of tool collet 10. To loosen fastening member/fastener 200, there is a predefined amount of torque to turn fastener 200 from its tightened position (i.e. range of about 4-5 ft-lbs) to a position that is 180 degrees from the tightened position. At the 180 degree position of fastener 200, fastener 200 still requires a torque or shear of about 2 ft-lbs to further turn fastener 200 toward a loosened position. It is not until fastener 200 is turned about 360 degrees from the tightened position does the torque required to further loosen fastener 200 drop to 0 ft-lbs. This clearly indicates that positioning the radial through aperture 52 offset from plane 550, which bisects the angle formed by body component matting surfaces 54*a*, 54*b* and 64*a*, 64*b*, and using setscrew 106 within radial through aperture 52 and tightening setscrew 106 against the surface of hand tool 500 provides a mechanical advantage for locking fastener 200 in the tightened position.

Figure 16:
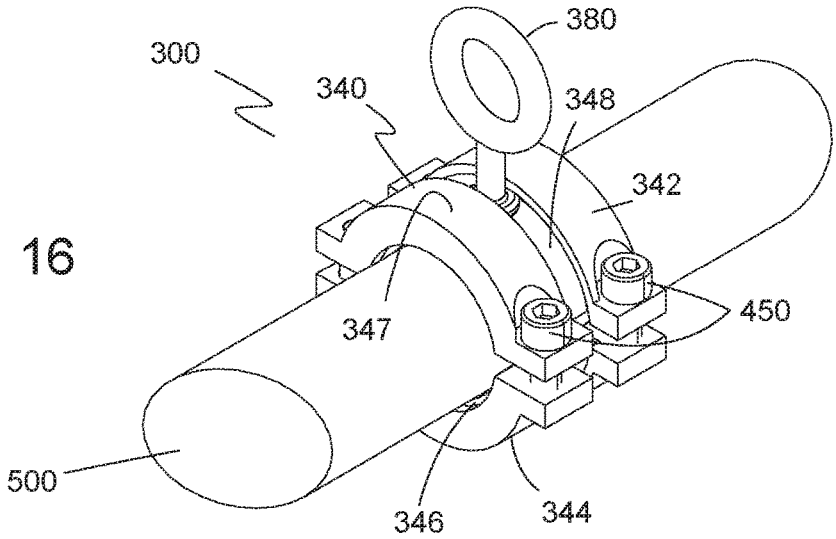
FIG. 16 is a perspective view of another embodiment of the tool collet for creating a lanyard attachment point on a hand tool.
Figure 17:
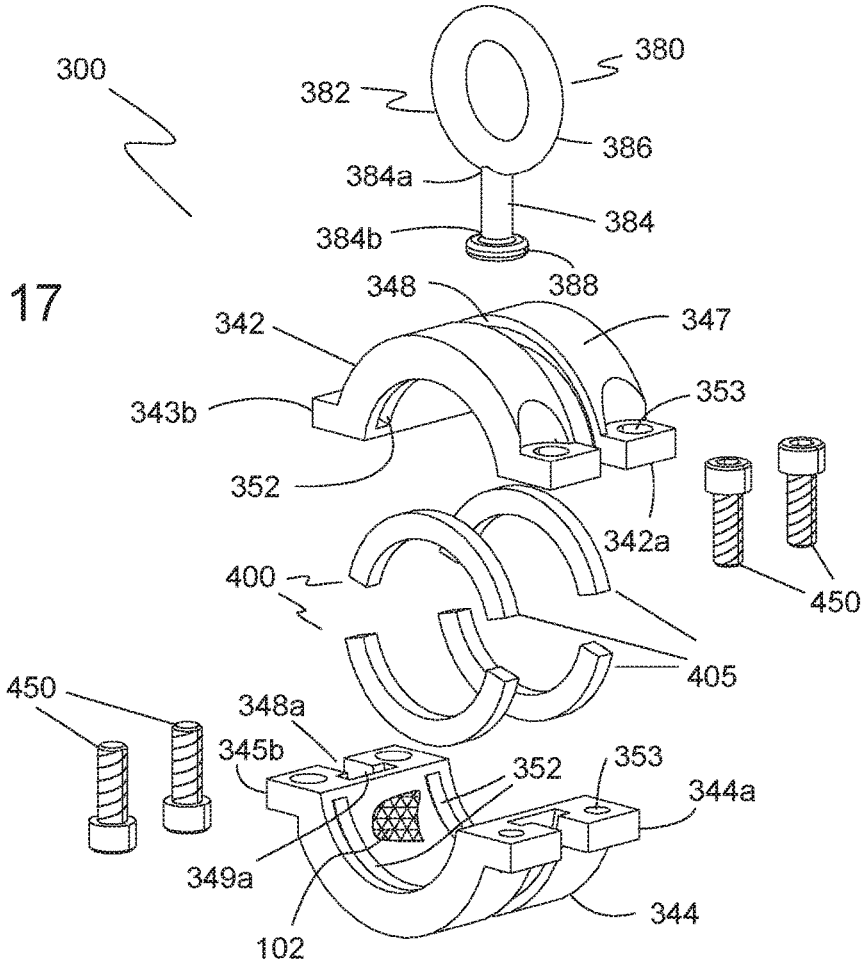
FIG. 17 is an expanded view of the tool collet shown in FIG. 16.

Turning now to FIGS. 16 and 17, there is illustrated another embodiment of a tool collet for creating a lanyard attachment point on a hand tool. Tool collet 300 includes a collet body 340, a lanyard ring 380 operatively engaged with collet body 340, and one or more fastening members 450 of collet body 340. In this Figure, tool collet 300 is shown mounted on a portion of a hand tool 500.

Tool body 340 has a first body component 342, a second body component 344, a collet through opening 346, and a peripheral body surface 347. Each of first and second body component 342, 344 has an annular groove 348 in peripheral body surface 347 that retains lanyard ring 380 in a captured but slidable orientation. Each of first and second body component 342, 344 has a set of flanges 342*a*, 344*a*, respectively, that extend transversely and outwardly from the peripheral body surface 347 a predefined distance. In one embodiment, each of first and second body component 342, 344 has at least one flange 342*a*, 344*a* on one end 343*a*, 345*a* while the opposite ends 343*b*, 345*b* are hingedly connected. In another embodiment, each of first and second body component 342, 344 has at least one flange 342*a*, 344*a* on opposite ends 343*b*, 345*b* instead of being hingedly connected. The set of flanges 342*a*, 344*a* are adapted to be opposed to each other and have fastening member openings 353 for receiving fastener members 450. Fastening members 450 secure first body component 342 and second body component 344 to each other while simultaneously clamping tool body 340 around hand tool 500. In this embodiment, annular groove 348 includes a first annular groove 348*a* with an annular recess 349*a*. Annular groove 348 may completely circumscribe tool collet 300 or may only reside in a portion of the peripheral surface 347. Within collet through opening 346, there is disposed an optional gripping member 400 that engages hand tool 500 and prevents the movement of tool collet 10 on hand tool 500.

Optional gripping member 400 may be a gripping structure 102 integrally made into collet opening surface 350 of collet through opening 346 (i.e. the inside surface of through opening 346). As previously discussed, one example of a gripping structure 102 includes but is not limited to a knurled finish on collet opening surface 350. Optional gripping member 400 may also be insert 104 (previously discussed) that is disposed within through opening 346. Another embodiment of gripping member 400 includes a plurality of flexibly resilient members 405 embedded within gripping member grooves 352 formed in collet opening surface 350. The depth of grooves 352 is less than the cross-sectional thickness of members 405 so that member 405 extends inwardly beyond collet opening surface 350 of collet through opening 346 to contact hand tool 500 at all times after tool collet 300 is attached to hand tool 500.

Annular groove 348 has a cross-section that is T-shaped disposed within peripheral body surface 347. In this embodiment, annular groove 348 forms a full circle or ring around peripheral body surface 347. By forming a full circle, annular groove 348 allows lanyard ring 380 to slide completely around the circumference of collet body 340.

Lanyard ring 380 has a ring body 382 with a ring body shaft 384, a closed ring 386 fixedly attached on one end 384*a* of ring body shaft 384, and a circular ear 388 fixedly attached on an opposite end 384*b* of ring body shaft 384. Circular ear 388 has a larger cross-sectional diameter than ring end 384*b*. Circular ear 384 also has a cross-sectional diameter and a thickness less that the recessed groove 349*a*, of annular groove 34 and is adapted to allow lanyard ring 380 to be captured within annular groove 348 and to freely slide around the circumference of collet body 340. Lanyard ring 380 provides an attachment point for a tool lanyard.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A method of creating a shear across a fastener for a tool collet being attached to a hand tool, the method comprising:

providing a tool collet for creating a lanyard attachment point on a hand tool, the tool collet comprising:

a collet body having:

a first body side, a second body side, a peripheral body surface extending between the first body side and the second body side, a collet through opening, and an opening surface, wherein the collet body being divided into a first body component and a second body component, and wherein each of the first body component and the second body component are adapted to be fixedly attached to each other, such that the through opening is formed by the first body component and the second body component, and wherein at least one of the first body component and the second body component has a first radial through aperture with a threaded portion, the first radial through aperture extending from the peripheral body surface radially inward to the collet through opening, and wherein the first radial through aperture has an axis which is angularly offset to and intersects with a plane, wherein the plane transversely bisects the peripheral body surface of the first body component and the second body component of the collet body;

one or more fastening members that extends between the first body component and the second body component within a fastener opening wherein the one or more fastening members are adapted to securely fix the first body component to the second body component;

providing a setscrew within the first radial through aperture;

inserting a portion of a hand tool into the collet through opening;

securing the first body component to the second body component using the one or more fastening members; and tightening the setscrew against the portion of the hand tool sufficient to cause the first body component and the second body component to slide in opposite directions transversely relative to the portion of the hand tool thereby creating a shear between the one more fastening members and the fastener opening.

2. The method of claim 1 further comprising providing a second radial through aperture with a threaded portion in the other of the at least one of the first body component and the second body component having the first radial through aperture, wherein the second radial through aperture extends from the peripheral body surface to the collet through opening.

3. The method of claim 2 wherein providing the second radial through aperture includes offsetting the second radial through aperture relative to the plane at an angle wherein an axis of the second radial through aperture intersects the plane.

4. The method of claim 2 further comprising providing a second setscrew within the second radial through aperture and tightening the second setscrew against the portion of the hand tool sufficient to cause the first body component and the second body component to slide in opposite directions transversely relative to the portion of the hand tool thereby creating a second shear between the one more fastening members and the fastener opening.

5. The method of claim 3 further comprising providing a second setscrew within the second radial through aperture and tightening the second setscrew against the portion of the hand tool sufficient to cause the first body component and the second body component to slide in opposite directions transversely relative to the portion of the hand tool thereby creating a second shear between the one more fastening members and the fastener opening.

6. The method of claim 1 further comprising providing a gripping member disposed at least partially within the collet through opening and at least partially between the collet body and the portion of the hand tool which is inserted into the collet through opening.

7. The method of claim 6 wherein providing the gripping member includes selecting the gripping member from one of (1) the opening surface having a gripping finish, (2) an insert having an insert through opening, and (3) one or more inserts disposed within one or more recesses in the opening surface.

8. The method of claim 7 further comprising selecting an annular insert that is resilient.

9. The method of claim 1 wherein providing the tool collet includes selecting an annular tool collet such that the peripheral body surface is annularly shaped.

10. The method claim 1 wherein providing the tool collet includes selecting the tool collet having an annular groove in one of the first body side, the second body side or the peripheral body surface of the collet body, and having a lanyard ring with an annular end disposed and captured within the annular groove.

* * * * *